United States Patent [19]

Thomas

[11] 4,124,143

[45] Nov. 7, 1978

[54] PILL DISPENSER

[75] Inventor: Michael D. Thomas, Arab, Ala.

[73] Assignee: Ryder International Corporation, Barrington, Ill.

[21] Appl. No.: 767,682

[22] Filed: Feb. 11, 1977

[51] Int. Cl.[2] ..... B65D 83/04

[52] U.S. Cl. ..... 221/82; 206/534; 206/538; 221/154

[58] Field of Search ..... 221/4, 5, 82, 83, 154; 206/533, 534, 538, 539; 116/121

[56] References Cited

U.S. PATENT DOCUMENTS

| | | | |
|---|---|---|---|
| 3,199,489 | 8/1965 | Ruoss et al. | 116/121 |
| 3,450,252 | 6/1969 | Hallerback | 206/534 X |
| 3,870,192 | 3/1975 | Haley | 221/154 X |
| 3,895,737 | 7/1975 | Phillips | 221/82 |
| 3,984,031 | 10/1976 | Thompson | 221/154 X |

*Primary Examiner*—Robert B. Reeves
*Assistant Examiner*—Francis J. Bartuska
*Attorney, Agent, or Firm*—Olson, Trexler, Wolters, Bushnell & Fosse, Ltd.

[57] ABSTRACT

There is disclosed a pill dispenser having a base member with a plurality of compartments formed therein for holding pills, a cover member rotatably supported on the base member in superposed relation to said compartments and having a pill exit opening alignable with a compartment to dispense a pill contained therein. The dispenser further includes locking arrangement having a releasable actuator member operable to free the cover member for rotation relative to the base member. The pill dispenser also may include an indexing calendar or dating member rotatably attached to the base member with markings corresponding to the pill compartments.

8 Claims, 14 Drawing Figures

PILL DISPENSER

BACKGROUND OF THE INVENTION

The present invention relates generally to a pill dispenser, and more particularly, to a pill dispenser incorporating locking means for preventing the dispensing of a pill therefrom until the locking means is released, said locking means having been designed such that children would experience difficulty in operating same, thereby rendering the dispensers "child-proof".

There is a growing need for means for dispensing medication and drugs on a closely controlled regimen. Many medications in pill or tablet form as, for example, oral contraceptives, must be taken at regular intervals over a given period of time in order to be effective. Further, the trend is to pre-package these pills at the site of manufacture, in convenient dispenser devices. Also, due to the nature of all medication that is a continuing need for pill dispensers which are easily operated by adults, but preclude easy access thereto by children.

SUMMARY OF THE INVENTION

Briefly, pill dispensers according to the present invention comprises three basic parts: a base member, a rotatable top or cover member and a locking means including a release or actuator member. The pill dispenser also includes a member such as a ring or a calendar or day indicator, which functions as a reminder to the user to take a pill, or that he or she has taken one. The preferred form of the invention shown in the drawings include base members of a generally circular shape and include a central portion which may be in the form of either a raised hub, or a circular recess and an annular recess concentric with the central portion in which is formed a plurality of compartments for holding the pills or tablets. The compartments are preferably of equal dimensions and evenly spaced around the recess and are defined by a plurality of partitions or relatively narrow walls formed in the recess running substantially to the top of the recess. The cover member is also generally circular and is mounted upon the base for rotation relative to the base member. The cover includes a pill exit port or opening of the same dimension as a single compartment in the base member to allow the exit of an individual pill therethrough. The dispeners also include locking means having a plurality of circumferencially disposed tabs or notches which are spaced to correspond to the spacing of the pill compartments of the base member.

In the first embodiment, the locking means includes a number of tabs formed on the cover, which cooperate with slot means in the base. Said slot means are provided with or include a ramp surface on either side of the slot, per se, which slot is of a suitable dimension to receive one of the locking tabs or lugs for holding the cover in a fixed position relative to the base, while preventing further rotation thereof. A release or actuator member is provided which occupies one of the pill compartments in the base and has a projection disposed in the lower portion of said slot, such that operation of actuator member will cause said projection to bias the tab out of said slot locking mechanism to allow rotation of the cover to the next adjacent pill compartment.

The construction of the second preferred embodiment is similar to the first, with the exception of the locking means. In this embodiment, the cover is provided with a plurality of slots, and a resiliently biased actuator is employed, including a tab or projection which can be selectively engaged and disengaged with one of said slots. This second embodiment, as well as the first, may include ratchet means permitting rotation of the cover relative to the base in but one direction. Both embodiments also include reminder or indexing means, of designs which are believed to be novel.

The entire pill dispenser is relatively compact to facilitate packaging and shipment thereof, and to allow the user to carry it in a relatively small space such as in a purse or pocket. The parts of the pill dispenser are preferably constructed of a plastic material so as to provide for the economical manufacture thereof. The cover member is preferably of a transparent material to facilitate the indexing of the dispenser and to provide at a glance a visual indication as to which pills have been taken and which remain to be taken.

The foregoing advantages, features and objects of the invention, as well as other objects and advantages will become apparent from the following description taken together with the accompanying drawings wherein like reference numerals throughout the various views designate similar elements or components.

DESCRIPTION OF THE ILLUSTRATED EMBODIMENTS

Figure 1:
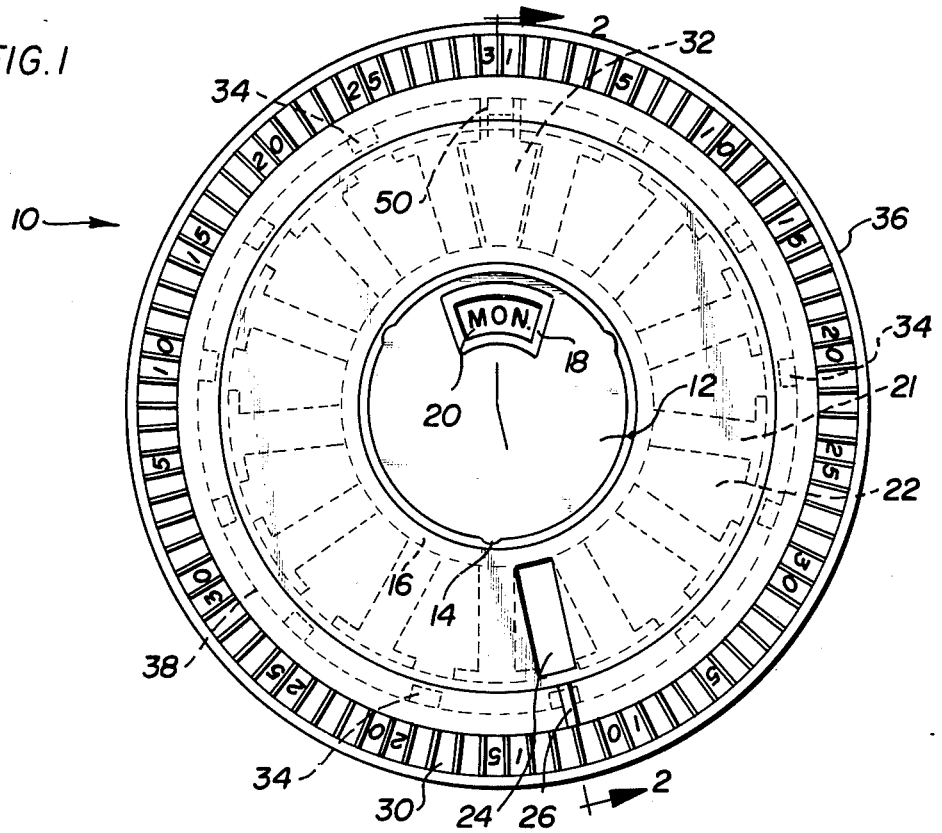
FIG. 1 is a plan view of a first embodiment of a pill dispenser incorporating features of the present invention.

Referring in detail to FIGS. 1-6 of the drawings, a pill dispenser 10 is illustrated constructed in accordance with a first embodiment of the invention. This embodiment includes a base member 36 which is generally circular, while the top or cover member 38 is of an annular construction. The locking means is designated generally 37 and includes an actuator member 32. The pill dispenser 10 as illustrated also includes an indexing or reminder ring 30 and a calendar member 20.

The base member 36 is formed with a raised central portion or hub 12, and has an annular recess containing or divided into a plurality of pockets or compartments 22 of equal dimensions, which are defined by the partitions 21 disposed radially around the hub 12. The base 36 also includes an upstanding, annular wall 33 disposed concentrically with the hub and to provide the outer circumferential wall of the compartments 22. Outwardly of wall 33 there is provided a generally horizontal wall portion 29 having an annular recess 31 formed therein. An indexing or reminder ring 30 is rotatably mounted in the recess 31 for a purpose to be described. The cover member 38 is rotatably engaged or attached to the base 36 at the hub 12 thereof by the interaction of lip or flange 16 formed in the inner circumference of the annular cover 38 with a plurality of tabs or projections 14 formed in the circumference of the hub 12. When so positioned, said cover 38 overlies a flange 54 on the reminder ring 30 to maintain said ring in assembly. Additionally, the cover 38 has an opening or pill exit port 24 formed in the top thereof and a raised portion or indicator 26 adjacent thereto which will cooperate with the indicia or indexing marks on the index ring 30 adjacent thereto. The exit port 24 is sized in relation to the compartments 22 to permit disposing of one pill at a time.

The locking mechanism 37 for the pill dispenser 10 of the initial embodiment of the invention under discussion will now be considered. In this regard, said locking means or mechanism 37 includes the means for fixing the position of the cover 38 with respect to the base 26 while attaining alignment of the dispensing or exit port 24 with a compartment, and also the actuator means for releasing the cover 38 for rotation. With regard to the specific construction of said mechanism 37, it should be noted that the cover member has a plurality of projections or ears 34 formed on the bottom surface portion of said cover 38 adjacent the peripheral edge thereof, as best seen in FIGS. 1, 2, 4 and 5. The projections 34 are equally spaced with the increment of spacing corresponding generally to the center or radial axis of the pill compartments 22. A opening or slot 48 is provided in the base 36, which slot is defined by opposing, spaced ramp surfaces 44 and 46. The slot 48 is sized to receive and hold an individual projection 34 therein, thereby precluding rotation of the cover 38 and locking said cover in position with respect to the base 36, with the pill exit port 24 above a selected compartment 22. The pill exit port 24 may then be aligned with the next adjacent pill compartment 22 only after releasing the described locking mechanism and effecting manual rotation.

The means for releasing the tabs or projections 34 from the slot means 48 will now be considered. In this regard, a release or actuator member 32 is carried by the compartment 22 opposite the slot means 48. The said compartment has an opening 50 formed in the outer wall portion 33 and an additional, aligned opening 52 in the horizontal wall section 29. Said actuator member 32 has an operating tab 42 extending through said openings 50 and 52 and disposed below the bottom surface of base 36. As can be clearly seen in FIG. 6, the openings 50 and 52 align with the aforementioned slot 48.

Figure 4:
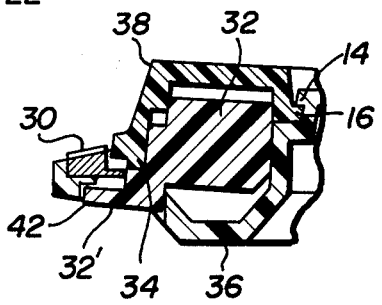
FIG. 4 is an elevational view of a portion of FIG. 2 illustrating the operation of various parts thereof.
Figure 5:
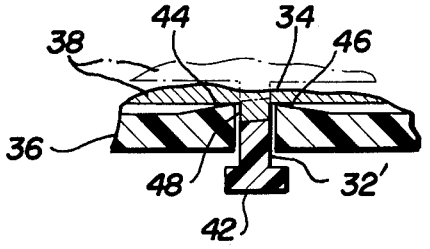
FIG. 5 is an elevational view taken generally along line 5—5 of FIG. 3.

As is best seen in FIGS. 4 and 5, a portion or segment 32' of the release member 32 is aligned with the projection 34 in the slot 48. With the described arrangement, the actuator member 32 is free to move upwardly relative to compartment 22, in response to manually applied pressure to the operating tab 42. In this regard, said actuator 32 includes an upper, flange-like portion 35 of a shape similar to that of compartment 22, which serves as a guide to assure upward movement without tipping. As can be appreciated when actuator 32 moves upward, segment 32' will engage tab 34 and move it upwardly of slot 48 to a position, (illustrated in phantom in FIG. 5), where said tab 34 is free of the slot edges so that manual rotation of the cover 30 can be effected.

Figure 2:
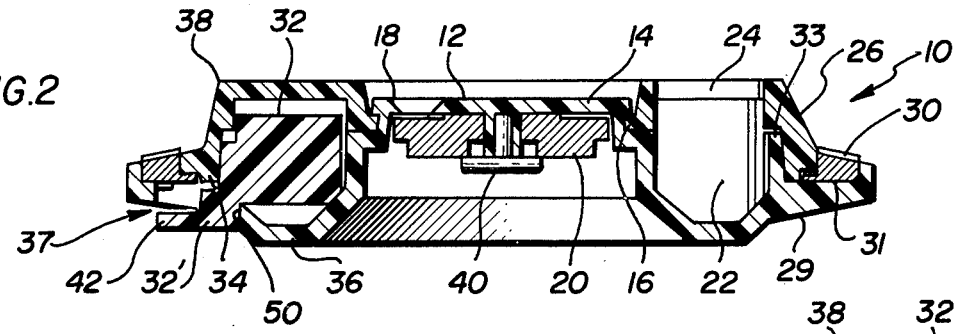
FIG. 2 is an elevational view taken generally along line 2—2 of FIG. 1.
Figure 3:
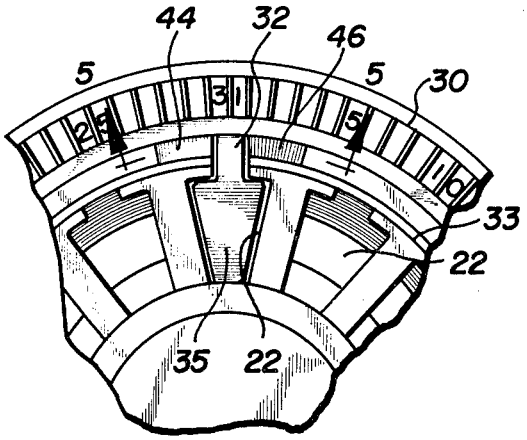
FIG. 3 is a top view of a portion of FIG. 1 revealing additional details thereof.

FIG. 2 shows the dispenser 10 in its locked position with the cover fixed against rotation, while FIG. 4 shows the cover member being released for rotation by upwards pressure upon actuator tab 42, thereby disengaging projection 34 from the slot 48. Upon rotation of cover 32, the next tab 34 will become engaged in slot 48, provided actuator 32 is released, with the exit port 24 now aligned with new compartment 22.

It is to be noted that the resilient nature of the plastic materials used in the construction of the cover portion 38 allow the relatively small degree of flexure required thereof to push locking tab 34 a relatively small distance required to release it from the slot 48 without causing permanent damage or deformation to the material.

Figure 6:
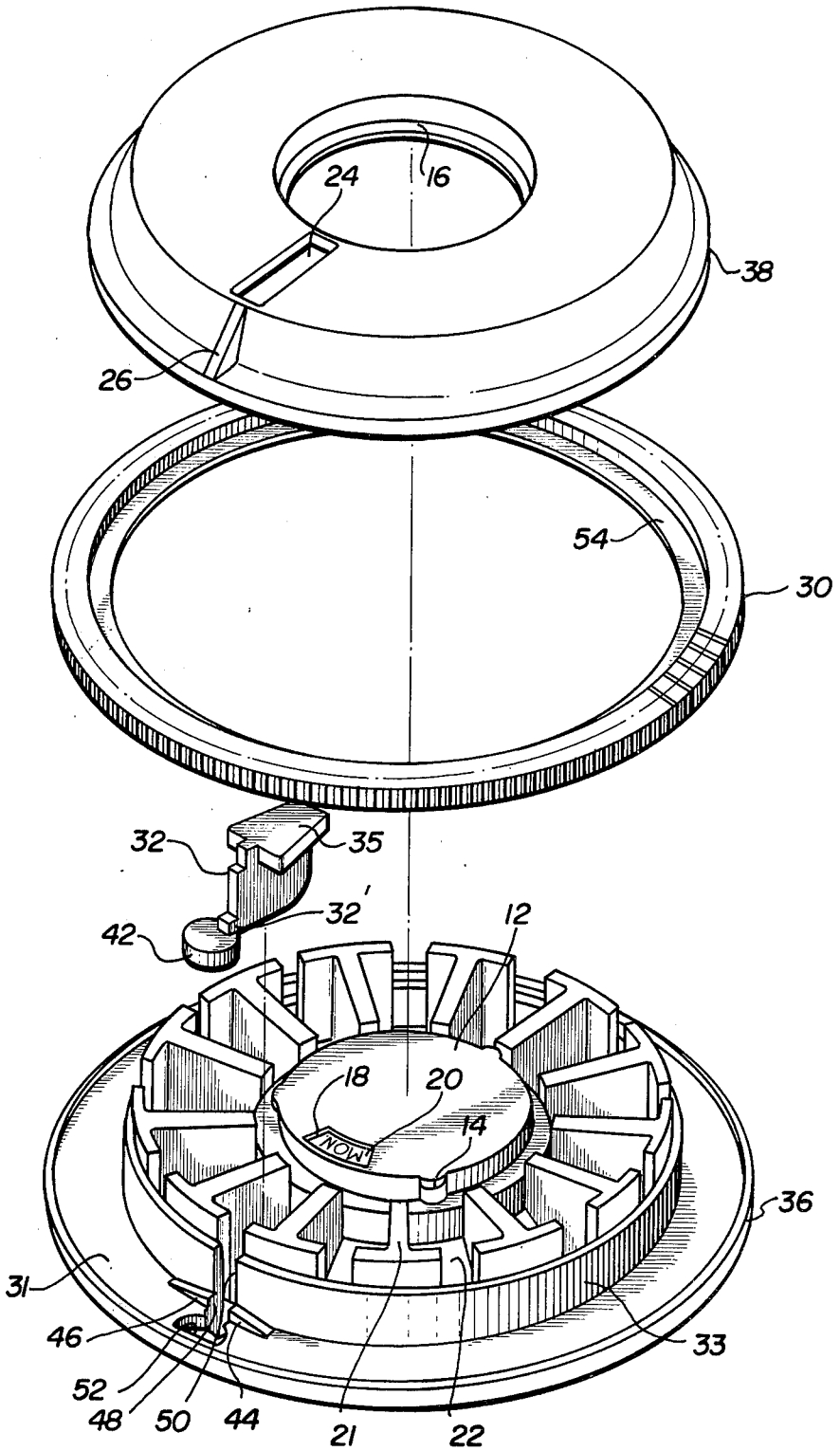
FIG. 6 is an exploded view of the pill dispenser of FIG. 1.
Figure 7:
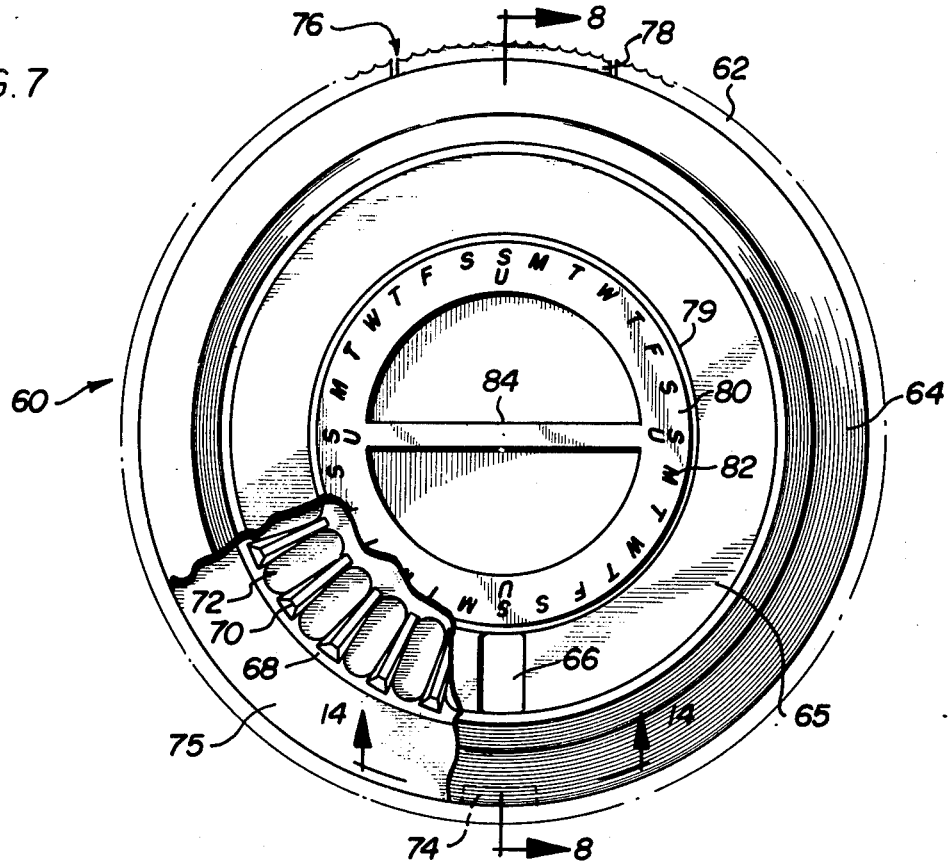
FIG. 7 is a plan view of a second embodiment of a pill dispenser incorporating features of the present invention.

Also provided in a preferred embodiment, as best seen in FIGS. 1, 2 and 6, is a day or date indicator 20 which is rotatably mounted upon the hub 12 by suitable means such as lug nut 40, so as to be readable through opening 18 provided therefore in the hub.

Having thus described the parts and components of a pill dispenser in accordance with the present invention, the method of operation thereof should become apparent. When supplied to the user, the pill exit port or opening 24 is preferably positioned above the compartment 22 containing the release tab 32, or is otherwise blocked, as by a break-off panel. Thus, all of the pills in the dispenser which are in the remaining compartments 22 are protected and held in place against dispensing by the cover 38. The user may then rotate the day or date indicator wheel 20 by reaching through the open central portion at the bottom of the base 36 until the desired indication appears in the window 18 of the hub 12. In the illustrated example of FIG. 1, days of the week are indicated on the wheel 20 for the case in which the medication is to be taken once a week. This then provides a constant reminder to the user of the day of the week on which the medication is to be taken. This indicator may of course, be modified to indicate any desired indicia of periodicity to accommodate medications to be taken on varying periodic regimens.

The user would then rotate the pill exit port 24 to the first adjacent pill compartment to take the first pill. This is accomplished, as already described, by pushing up on the release tab 32 to push or force locking tab 34 out of the retaining slot 48 freeing the cover portion 38 for rotation. The user than releases tab 32 as soon as the cover begins to rotate, so that the next adjacent locking the tab 34 will ride up the ramp 46 and be locked into place in the retaining slot 48, thereby locking the pill exit port 24 into position over the first pill compartment 22.

The user then rotates the indexing ring 30 so that a marking thereon (corresponding to the time at which the first pill was taken) comes into alignment with the indicator 26. In the embodiment illustrated in FIG. 1 the markings on the indexing ring are days of the month and are spaced to index the dispenser for pills which are to be taken weekly. Thus, once the indexing ring has been set with the appropriate date adjacent the first compartment, the remaining compartments are each adjacent to the marking indicating the date at which their respective pills are to be taken, and the indexing ring need not be moved again. It is obvious that the indexing ring can be modified to properly index all the compartments of a dispenser for pills to be taken at regular intervals of any length, such as every three days, every day, or every so many hours by providing appropriate markings at suitable intervals on the indexing ring 30. The indexing ring is held between the base 36 and cover 38, as best seen in FIG. 2, to prevent the turning thereof freely but still allow the initial adjustment of the position of the ring as hereinabove described.

Referring now in detail to FIGS. 7–14, a second embodiment of a pill dispenser in accordance with the present invention is illustrated. As in the first embodiment, the three basic parts of the pill dispenser 60 are, base member 62, top or cover member 64 and locking means designed generally 77, which includes a manually operable actuator member 78. The pill dispenser 60 also includes cap member 80.

The generally circular base member 62 is formed with a recessed circular central portion 79 and an annular recess 70 disposed concentrically with the central portion and containing a plurality of pill pockets or compartments 72 of equal dimensions defined by a plurality of walls 68 extending radially from the central portion 79. A second, shallower annular recess 75, (FIG. 9) is also provided in the base 62 concentric with the central portion and disposed around the outer edge of the pill compartments 72. A generally arcuate, E-shaped slot 76 is formed in a portion of this recess 75. In addition, a single ratchet tooth or ramp 74 is provided in the recess 75 generally opposite the arcuate opening 76.

Cover member 64 is rotatably mounted upon the base 62, by the cap member 80, which overlies an inner peripheral edge of the cover 64, and is frictionally engaged with central recess 79 of said base. The cover member 64 is generally annular in shape having a circular opening in the center thereof corresponding to the recessed central portion of the base and a raised portion 65 concentric with the central opening and of substantially the same dimension as the walls 70 forming the pill compartments 72 so as to form a cover for pill compartments 72. The outer peripheral portion 67 of cover 64 is disposed in recess 75 of the base in sliding engagement therewith. The raised portion 65 of the cover member 64 also includes a pill exit port or opening 66 of substantially the same size and shape as a single pill compartment 72 to allow the exit of a single pill therethrough.

The generally circular cap member 80 is frictionally engaged into the central portion 79 of the base 62 in a manner, so as to allow rotation of the cover 64 with respect thereto while resisting removal therefrom. A flange or lip 83 is provided on member 80 to hold the cover 64 in place by engaging complementary flange 90 of the cover 64 thereunder which in turn holds the actuator member 78 in place, completing the assembly of the pill dispenser 60. Cap member 80 is also provided with a plurality of indexing marks 82 to correspond to the pill compartments 72. In the illustrated embodiment, these indexing marks are in the form of letters representing the days of the week. It is to be understood, however, that the indexing marks may be in various forms, such as numbers representing dates or hours, without departing from the scope of the present invention.

Figure 9:
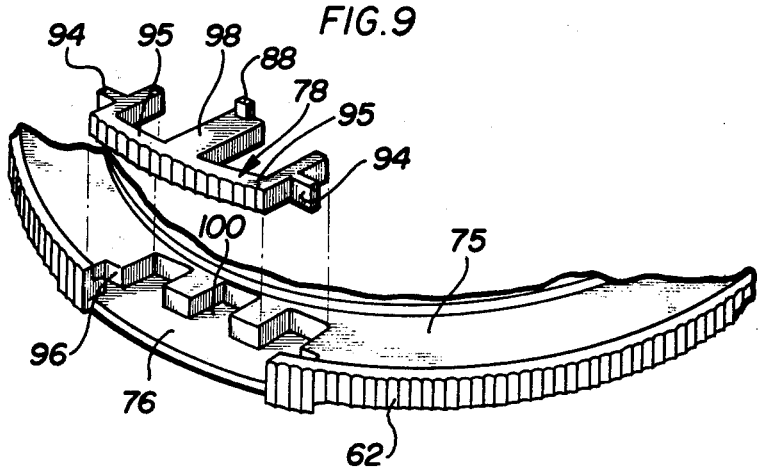
FIG. 9 is an exploded view of a portion of FIG. 7 showing additional details thereof.

The relationship of actuator member 78 relative to the slot 79 provided therefore in the base 62 is best seen in FIG. 9. Release or actuator member 78 is generally E-shaped having anchoring lugs 94 on either end which are fitted into complementary openings or grooves 96 formed in the side walls of the slot 76. The central member 98 of the "E" shaped actuator 78 is somewhat longer than the end or arm portion 95 forming the "E" and is fitted into portion 100 of slot 76 which is somewhat longer than member 98 of the actuator member 78 fitted therein. Member 98 also includes a locking tab 88 projecting from its end and on the top side thereof.

Figure 10:
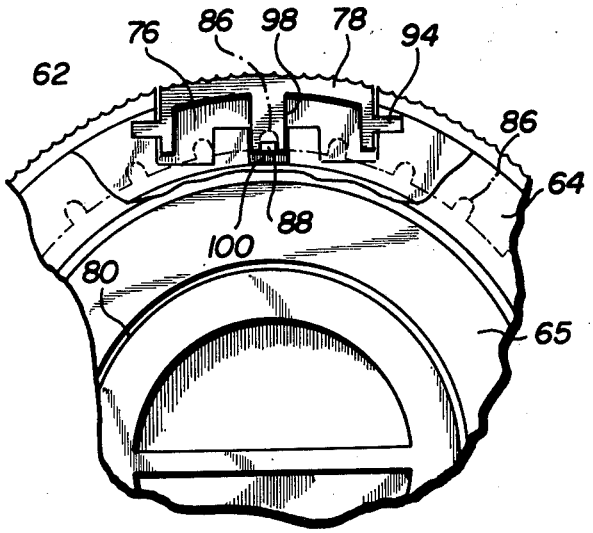
FIGS. 10 and 11 are cut-away views of a portion of FIG. 7 showing additional details thereof.
Figure 11:
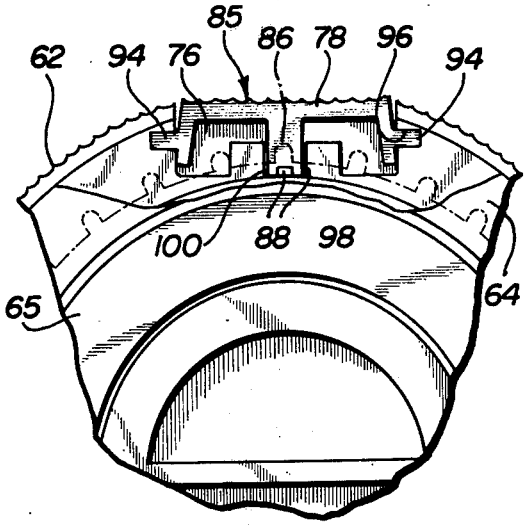

The mechanism and function for locking and releasing rotatable cover 64 is seen best in FIGS. 10 and 11. In FIG. 10, the cover 64 is shown in conjunction with actuator 78 in its locked poistion. It will be noted that the cover 64 is provided with a plurality of relatively shallow slots 86 opening radially inward and disposed around the outer circumference of the raised portion 65 at the bottom thereof and having substantially the same spacing therebetween as the spacing between adjacent compartments 72. The locking tab 88 of the release or actuator member 78, when in its normal position of FIG. 10 is disposed to be engaged in one of the slots 86 thus effectively locking the cover 64 against rotation relative to the base 62.

FIG. 11 shows the actuator member 78 in operated or release position after manual depression thereof. The actuator member 78 is constructed of a relatively resilient material so that the application of pressure in the direction indicated by arrow 85 will cause actuator 78 to flex or resiliently deform somewhat with respect to opening 76, causing member 98 of the actuator 78 to bottom in the opening 100 provided therefore until the pressure 85 is released. When this occurs, as seen in FIG. 11, the locking tab 88 is removed from an associated slot 86, leaving the cover 64 free to rotate with respect to the base 62.

Due to the inherent resiliency of the member 78, and the spring-like action obtained by anchoring lugs 94 in groove 96, upon release of the member 78 it will tend to return to its original position, FIG. 10. Assuming that rotation of the cover 64 has commenced prior to the actuator being released, the resiliency of the member 78 will cause the tab 88 to engage the arcuate surface portion 91 on the cover and disposed between the respective slots 86. Thus rotation of cover 64 can continue until a subsequent slot 84 is aligned with tab 88, at which point the above-mentioned spring action will cause tab 88 to be engaged in said slot 86 to again block rotation of said cover.

Figure 8:
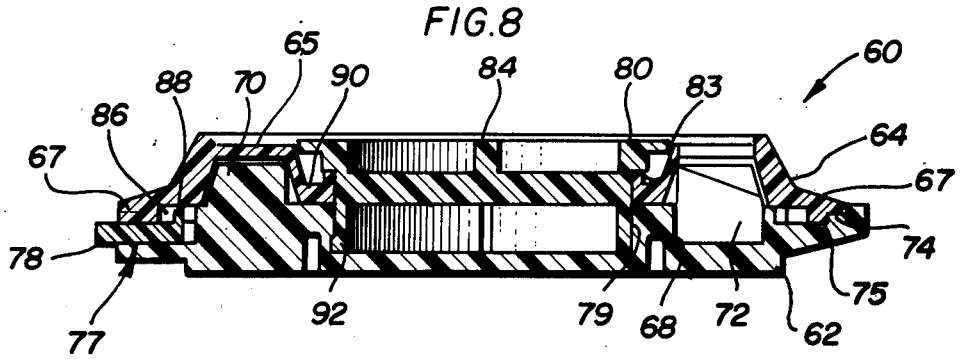
FIG. 8 is a sectional view taken generally along line 8—8 of FIG. 7.
Figure 12:
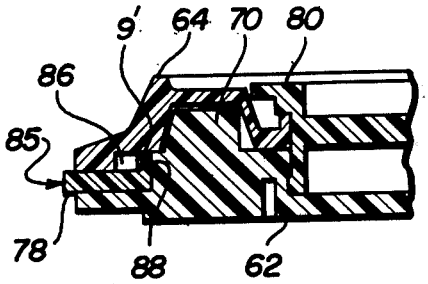
FIG. 12 is a view of a portion of FIG. 8, illustrating further the operation of a pill dispenser according to the present invention.

The above-discussed locking and releasing actions are also illustrated in FIGS. 8 and 12. In FIG. 8, the locking tab 88 is shown in engagement with slot 86, locking the cover 64 against rotation relative to the base 62. In FIG. 12, the actuator 78 is shown under the action of force or pressure indicated by arrow 85, with its locking tab 88 removed from slot 86, thereby allowing rotation of the cover 64 with respect to the base 62.

Figure 13:
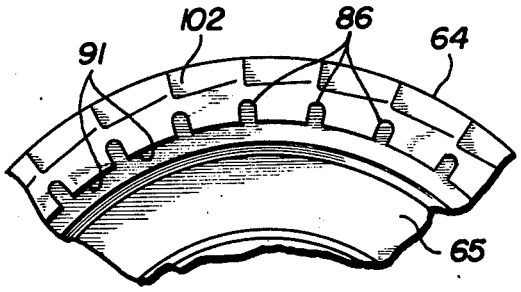
FIG. 13 is a bottom view of a portion of FIG. 8 showing additional details thereof.
Figure 14:
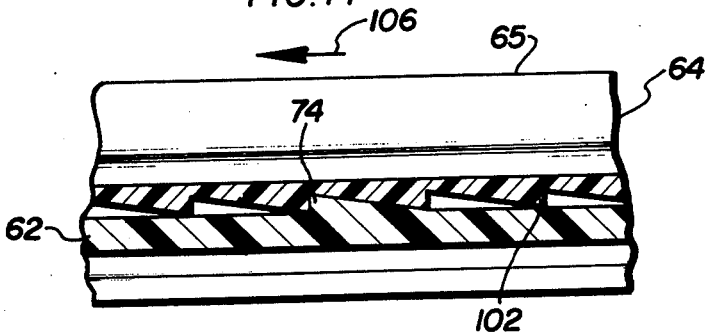
FIG. 14 is a side elevational view taken generally along line 14—14 of FIG. 7 and showing additional details thereof.

FIGS. 13 and 14 illustrate portions of the pill dispenser which limit the rotation of the cover 64 with respect to the base 62 to a single direction. In FIG. 13, a bottom view of a portion of cover 64, there can be seen a series of ratchet teeth 102 dormed on and disposed circumferentially along an outer edge of cover 64. The ratchet teeth 102 are formed so that the circumferential dimension of each is substantially equal to the spacing between adjacent pill pockets 72. The locking slots 86 are also more clearly illustrated in FIG. 13. In FIG. 14, the interaction of the ratchet teeth 102 with ramp 74 of the base 62 is shown. It can be seen that the rotation of the cover 64 relative to the base 62 is limited by the ramp 74 and ratchet teeth 102 to the direction indicated by arrow 106. The shape of the cover 64 and material from which it is formed are such that the slight deformation necessary to move the ratchet teeth 102 past ramp 74 in the direction of arrow 106, is realized without damage or permanent deformation of the cover 64.

The various parts of a second embodiment of a pill dispenser in accordance with the present invention have been shown and described, the operation thereof should be apparent. When the user receives the pill dispenser, the opening 66 is either provided with a removable cover or is positioned over an empty compartment 72. The user may then rotate the cap member 80 by grasping its central raised axis 84 to move the appropriate indexing marking 82 into alignment with the appropriate pill compartment to indicate the first pill to be taken and the day, time or date at which it is to be taken. Thus, the remaining markings 82 on the cap member 80 will be properly aligned with the remaining compartments 72 to indicate, consecutively, the day, time or date for taking each of the remaining pills, and cap member 80 need not be moved again. In order to remove the first pill from its compartment 72, the user 62 applies pressure on the actuator member 78 in the direction indicated by arrow 85 of FIGS. 11 and 12. This releases the locking mechanism formed by tab 88 and slot 86 and the user may then simultaneously rotate the cover member 64 until the pill exit port 66 begins to rotate at which time the actuator 78 may be released. The user than continues to rotate the cover member 64 until the pill exit port or opening 66 comes into alignment with the first pill compartment at which time the actuator member 78 will return to its undeformed state causing tab 88 to engage the next adjacent slot 86 thereby preventing further rotation. The pill may then be removed from its compartment 72 by inverting the pill dispenser to allow exit of the pill through exit port 66. The remaining pills may be dispensed in the same manner on the days, dates or times indicated by the markings on the cover member by following the same procedure to rotate the cover in the proper direction which, due to the ratchet teeth 102 and ramp 74 as illustrated in FIG. 14, is the only direction in which the cover may be rotated.

While specific embodiments of the present invention have been shown and described therein, it will be understood that changes and modifications may be made without departing from the spirit and scope of the invention as defined in the appended claims.

The invention is claimed as follows:

1. A pill dispenser comprising; a base member having formed thereon a central portion, and a plurality of radially disposed compartments concentric with said central portion, a cover member mounted upon said base member for rotation relative to said base member and having a pill exit opening formed therein to permit selectively the exit of a single pill from one of said compartments while covering the others of said compartments, and releasable locking means to lock said cover against rotation and release said cover for manual rotation relative to said base upon manual operation thereof, and cap ratchet means formed on said cover and base member permitting rotation of said cover relative to said base member in only one direction, said locking means comprises a plurality of slots formed in said cover member having substantially the same spacing therebetween as said compartments, and an actuator member carried by said base member including a tab thereon engageable in one of said slots to block relative rotation, and biasing means urging said actuator member to a position where said tab will be disposed in one of said slots, said actuator being biasable to a second position to disengage said tab from said slot, wherein said actuator comprises a resilient element having a central portion with said tab formed thereon, and a pair of oppositely extending arm segments disposed generally transverse of said central portion, groove means formed in said base member and receiving an end portion of each said arm segment to anchor said arm segments, such that said actuator is flexible about said anchored arm segments and can be manually urged to move said central portion to said second position, with said flexed arm segments functioning as said biasing means to return said central portion and the tab thereon to said first position when released.

2. A pill dispenser comprising; a base member having formed thereon a central portion, and a plurality of radially disposed compartments concentric with said central portion, a cover member mounted upon said base member for rotation relative to said base member and having a pill exit opening formed therein to permit selectively the exit of a single pill from one of said compartments while covering the others of said compartments, and releasable locking means to lock said cover against rotation and release said cover for manual rotation relative to said base upon manual operating thereof, and cap ratchet means formed on said cover and base member permitting rotation of said cover relative to said base member in only one direction, said locking means comprises a plurality of slots formed in said cover member having substantially the same spacing therebetween as said compartments, and an actuator member carried by said base member including a tab thereon engageable in one of said slots to block relative rotation, and biasing means urging said actuator member to a position where said tab will be disposed in one of said slots, said actuator being biasable to a second position to disengage said tab from said slot, wherein said actuator comprises a generally E-shaped member, including a central portion having said tab thereon, a pair of oppositely disposed arm segments extending transversely of said central portion, and each said arm segment including an end flange extending generally in the same direction as said central portion, and an anchoring lug extending transversely of each said end flange, said base member including recess means formed therein to receive said actuator, said recess means including a pair of opposed grooves for receiving said anchoring lugs and a slot in which said central portion is disposed, said generally E-shaped member being resilient and flexible about said anchoring lugs such that same may be depressed to move said central portion inwardly from said first position to said second position, with said slot guiding movement thereof, and said arm segments flexing upon said movement, such that when said member is released, said flexed arm member will bias said central portion back to said first position.

3. A pill dispenser comprising; a base member having formed thereon a raised central hub portion and a plurality of radially disposed compartments concentric with said hub portion, a cover member rotatably mounted on said hub portion and having a pill exit port formed therein for permitting selectively the exit of a pill from one of said compartments while covering the others of said compartments, releasable locking means formed on said cover member and said base member, which when engaged prevent relative rotation of said cover member, said releasable locking means comprise a plurality of projections formed on said rotatably mounted cover member and means on said base member defining a slot for receiving and holding one of said projections, and an actuator member carried by said base member and including detent means aligned with said slot, such that movement of said actuator will cause said detent means to engage a projection in said slot and displace said projection from said slot thereby freeing said cover member for rotation.

4. The pill dispenser of claim 3 wherein said actuator member is mounted in one of said compartments and further includes a tab and said base member further includes an opening adjacent said one of said compartments and adjacent said slot, said actuator tab extending below said base through said opening to facilitate engagement thereof.

5. A pill dispenser according to claim 3 wherein said means defining said slot includes a pair of spaced, ramp surfaces.

6. A pill dispenser comprising; a base member including a central portion and a plurality of radially disposed compartments concentric with said central portion, a cover member mounted upon said base member for rotation relative thereto and having a pill exit opening formed therein to permit selectively the exit of a single pill from one of said compartments while covering the others of said compartments, and selectively operable locking means for locking said cover against rotation and releasing said cover for manual rotation relative to said base upon operation of said locking means, said locking means comprising a plurality of circumferentially disposed slots formed in said cover member, said slots extending generally radially and opening in a radially inward direction, said slots having substantially the same spacing therebetween as said compartments, and actuator means separate from and carried by said base member including a relatively movable element disposed for movement generally parallel to said slots, a tab provided on an inboard portion of said element to be selectively engaged in one of said slots to block movement of said cover member relative to said base member, and biasing means urging said element to a first, radially outboard position where said tab will be disposed in one of said slots, said movable element being movable against the action of said biasing means to a second, radially inboard position to disengage said tab from said slot, and free said cover for rotation relative to said base.

7. A pill dispenser comprising; a base member including a central portion and a plurality of radially disposed compartments concentric with said central portion, a cover member mounted upon said base member for rotation relative thereto and having a pill exit opening formed therein to permit selectively the exit of a single pill from one of said compartments while covering the others of said compartments, and selectively operable locking means for locking said cover against rotation and releasing said cover for manual rotation relative to said base upon operation of said locking means, said locking means comprising a plurality of circumferentially disposed slots formed in said cover member and opening in a radially inward direction, said slots having substantially the same spacing therebetween as said compartments, and actuator means carried by said base member including a tab adapted for engagement in one of said slots said actuator means comprising a resilient element having a central portion with said tab formed thereon, and a pair of oppositely extending arm segments disposed generally transverse of said central portion, groove means formed in said base member and receiving an end portion of each said arm segment to anchor said arm segments, such that said actuator is flexible about said anchored arm segments and can be manually urged from a first position wherein said tab will be disposed in one of said slots to move said central portion to a second position to disengage said tab from said slot and free said cover for rotation relative to said base, with said flexed arm segments functioning as biasing means to return said central portion and the tab thereon to said first position when released.

8. A pill dispenser comprising; a base member including a central portion and a plurality of radially disposed compartments concentric with said central portion, a cover member mounted upon said base member for rotation relative thereto and having a pill exit opening formed therein to permit selectively the exit of a single pill from one of said compartments while covering the others of said compartments, and selectively operable locking means for locking said cover against rotation and releasing said cover for manual rotation relative to said base upon operation of said locking means, said locking means comprising a plurality of circumferentially disposed slots formed in said cover member and opening in a radially inward direction, said slots having substantially the same spacing therebetween as said compartments, and actuator means carried by said base member including a tab adapted for engagement in one of said slots said actuator comprising a generally E-shaped member, including a central portion having said tab thereon, a pair of oppositely disposed arm segments extending transversely of said central portion, and each said arm segment including an end flange extending generally in the same direction as said central portion, and an anchoring lug extending transversely of each said end flange, said base member including recess means formed therein to receive said actuator, said recess means including a pair of opposed grooves for receiving said anchoring lugs and a slot in which said central portion is disposed, said generally E-shaped member being resilient and flexible about said anchoring lugs such that same may be depressed to move said central portion inwardly from a first position wherein said tab will be disposed in one of said slots to a second position to disengage said tab from said slot and free said cover for rotation relative to said base member, with said slot guiding movement thereof, and said arm segments flexing upon said movement, such that when said member is released, said flexed arm member will bias said central portion back to said first position.

* * * * *